US010072364B2

(12) United States Patent
Goenka

(10) Patent No.: US 10,072,364 B2
(45) Date of Patent: Sep. 11, 2018

(54) RAPID DRYING WOVEN TERRY FABRIC AND RELATED ARTICLES

(71) Applicant: WELSPUN INDIA LIMITED, Mumbai (IN)

(72) Inventor: Dipali Goenka, Mumbai (IN)

(73) Assignee: Welspun India limited, Mumbai (IN)

( * ) Notice: Subject to any disclaimer, the term of this patent is extended or adjusted under 35 U.S.C. 154(b) by 0 days.

(21) Appl. No.: 15/110,207

(22) PCT Filed: Dec. 22, 2015

(86) PCT No.: PCT/IN2015/050211
§ 371 (c)(1),
(2) Date: Jul. 7, 2016

(87) PCT Pub. No.: WO2016/103281
PCT Pub. Date: Jun. 30, 2016

(65) Prior Publication Data

US 2016/0333506 A1 Nov. 17, 2016

(30) Foreign Application Priority Data

Dec. 22, 2014 (IN) ..... 4119/MUM/2014

(51) Int. Cl.

| | |
|---|---|
| ***A41D 27/08*** | (2006.01) |
| ***D03D 27/08*** | (2006.01) |
| ***D03D 15/00*** | (2006.01) |
| *D03D 27/00* | (2006.01) |

(52) U.S. Cl.
CPC ..... *D03D 27/08* (2013.01); *D03D 15/0027* (2013.01); *D10B 2401/021* (2013.01); *D10B 2401/022* (2013.01)

(58) Field of Classification Search
CPC ..... D03D 27/08; D03D 15/00; D03D 1/0017; D03D 27/00; D03D 15/0027; D03D 13/008; D03D 27/02; D03D 13/004
See application file for complete search history.

(56) References Cited

U.S. PATENT DOCUMENTS

| | | | | |
|---|---|---|---|---|
| 2,936,569 A * | 5/1960 | Mull | D02G 3/24 | 57/239 |
| 3,721,272 A * | 3/1973 | Hager | D03D 27/08 | 139/396 |
| 6,062,272 A * | 5/2000 | Waite | D03D 15/00 | 139/420 A |
| 7,011,116 B2 * | 3/2006 | Krumm | D03D 39/226 | 139/190 |

(Continued)

FOREIGN PATENT DOCUMENTS

WO WO 2013/026422 A1 2/2013

*Primary Examiner* — Bobby Muromoto, Jr.
(74) *Attorney, Agent, or Firm* — Offit Kurman, P.A.; Gregory A. Grissett

(57) ABSTRACT

A terry fabric includes a ground component comprising a plurality of warp yarns and a plurality of weft yarns interwoven with the plurality of warp yarns. At least one of the plurality of warp yarns and the plurality of weft yarns include 5 twisted or plied yarns. The woven terry fabric includes a pile component that projects from the ground component in a direction away from the ground component. The pile component includes a plurality of piles that include absorbent pile yarns interwoven with the plurality warp yarns and the plurality of weft yarns.

38 Claims, 3 Drawing Sheets

(56) References Cited

U.S. PATENT DOCUMENTS

| | | | | |
|---|---|---|---|---|
| 7,673,656 | B2 * | 3/2010 | Heiman | D03D 27/08 139/391 |
| 8,733,075 | B2 * | 5/2014 | Mandawewala | D02G 3/36 139/1 R |
| 9,677,201 | B2 * | 6/2017 | Mandawewala | D02G 3/36 |
| 2009/0025818 | A1 * | 1/2009 | Hozumi | D03D 1/0017 139/392 |
| 2014/0317865 | A1 * | 10/2014 | Krishna | D03D 27/08 15/209.1 |

* cited by examiner

RAPID DRYING WOVEN TERRY FABRIC AND RELATED ARTICLES

CROSS-REFERENCE TO RELATED APPLICATIONS

This application is the National Stage of International Application No. PCT/IN2015/050211, filed Dec. 22, 2015, which claims the benefit of Indian application number 4119/MUM/2014, filed Dec. 22, 2014, the disclosures of which are incorporated herein by reference in their entireties.

FIELD OF INVENTION

The present disclosure relates to woven terry fabrics, and in particular, to a rapid drying woven terry fabric, articles made from same, and methods of manufacturing. The present application claims the benefit of and priority to Indian Patent Application No. 4119/MUM/2014, filed Dec. 22, 2014, entitled "Rapid Drying Towel, the entire contents of which are incorporated by reference into the present application for all purposes.

BACKGROUND OF INVENTION

Terry fabrics for absorbent applications, such as towels, bathrobes, and the like, are typically made from cotton fibers. However, cotton terry fabrics have several disadvantages. While cotton terry fabrics have good moisture absorption, cotton fabrics do not dry out very quickly. A wet or soaked cotton terry fabric will not absorb additional moisture and usually takes a long time to dry out for subsequent use.

Furthermore, cotton terry fabrics can have low durability and may not withstand repeated laundering. Replacing cotton fibers with polyester addresses a number of disadvantages of associated with cotton terry fabrics. However, polyester terry fabrics are less absorbent than cotton fabrics. Polyester terry fabrics also have less loft, cushion, and bulk compared to cotton terry fabrics. Although polyester terry fabrics have a smooth hand, they tend to feel "plastic like" to the user.

The problems associated with exclusively cotton or polyester terry fabrics can be addressed to some extent by using cotton and polyester fiber blends. Cotton-polyester, terry fabrics are typically stronger and are more durable compared to either cotton terry fabrics or polyester terry fabrics. In some instances, the polyester fibers or fabrics are treated with compositions that improve moisture management.

OBJECT OF INVENTION

The principal object of the embodiments herein is to provide a method for producing washed down effect on delicate fabric like towels.

Another object of the embodiments herein is to provide a woven terry fabric with improved drying characteristics.

Yet another object of the embodiments herein is to provide a process a fabric for improved drying characteristics.

These and other objects of the embodiments herein will be better appreciated and understood when considered in conjunction with the following description and the accompanying drawings.

SUMMARY

Accordingly the embodiments herein provide a process for improved drying characteristics. In an embodiment, the fabric includes a terry based products. For example, a terry towel. The processes may be adapted to commercially available equipment with little or no added expense and without substantial increase in manpower and most particularly without damaging the fabric.

An embodiment of the present disclosure is a terry fabric. The terry fabric includes a ground component comprising a plurality of warp yarns and a plurality of weft yarns interwoven with the plurality of warp yarns. At least one of the plurality of warp yarns and the plurality of weft yarns includes a) plied continuous filament yarns and b) absorbent yarns. The woven terry fabric includes a pile component that projects from the ground component in a direction away from the ground component. The pile component includes a plurality of piles that include absorbent pile yarns interwoven with the plurality warp yarns and the plurality of weft yarns. The plied continuous filament yarns are adapted to transfer moisture from the plurality of absorbent pile yarns to the other yarns when the terry fabric is exposed to moisture, such that, terry fabric has rapid drying characteristics.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications can be made within the scope of the embodiments herein without departing from the spirit thereof, and the embodiments herein include all such modifications.

BRIEF DESCRIPTION OF FIGURES

This invention is illustrated in the accompanying drawings, throughout which like reference letters indicate corresponding parts in the various figures. The embodiments herein will be better understood from the following description with reference to the drawings, in which.

DETAILED DESCRIPTION OF INVENTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. Also, the various embodiments described herein are not necessarily mutually exclusive, as some embodiments can be combined with one or more other embodiments to form new embodiments. The term "or" as used herein, refers to a non-exclusive or, unless otherwise indicated. The examples used herein are intended merely to facilitate an understanding of ways in which the embodiments herein can be practiced and to further enable those skilled in the art to practice the embodiments herein. Accordingly, the examples should not be construed as limiting the scope of the embodiments herein.

Figure 1:
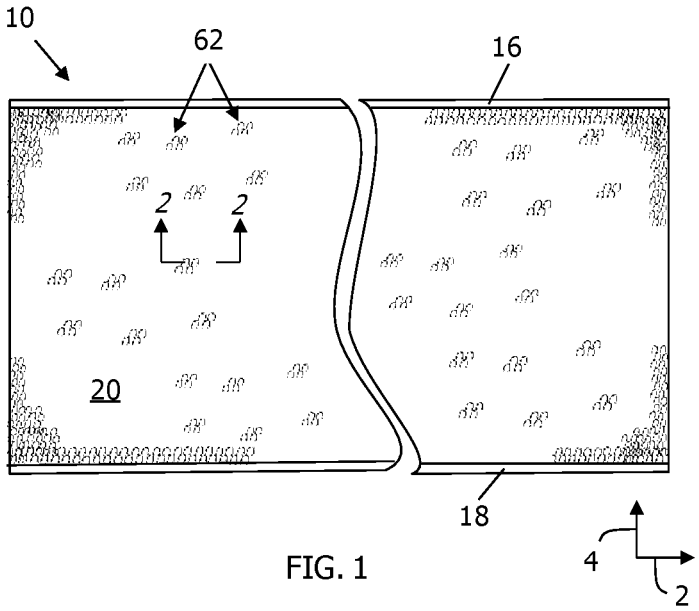
FIG. 1 is a schematic view a woven terry fabric according to an embodiment of the present disclosure.
Figure 2:
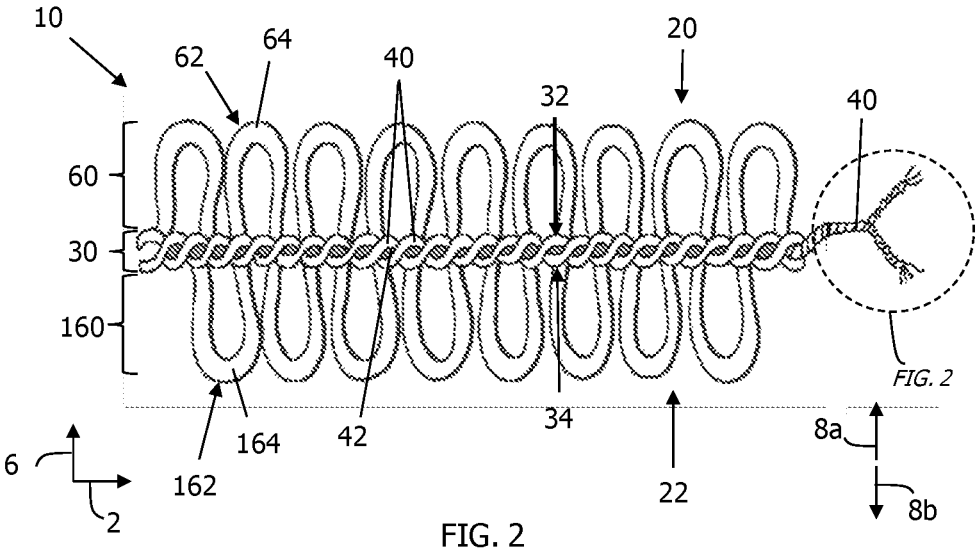
FIG. 2 is a cross-sectional view of a portion of the woven terry fabric taken along line 2-2 in FIG. 1.
Figure 3:
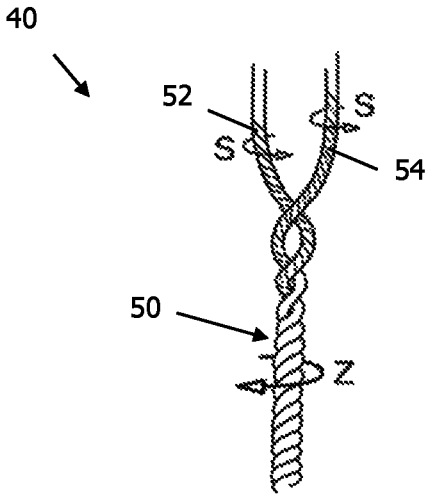
FIG. 3 is a schematic of a moisture transport yarn used in the woven terry fabric shown in FIG. 2.

Embodiments of the present disclosure include a woven terry fabric and articles formed therefrom having rapid drying characteristics. Referring to FIGS. 1 and 2, the woven terry fabric 10 includes a ground component 30 and at least one pile component that projects outwardly away from the ground component 30. The ground component 30 includes a plurality of warp yarns 40 and a plurality of weft yarns 42 interwoven with the plurality of warp yarns 40 into a suitable woven construction. The at least one pile component may include a first pile component 60 and a second pile component 160 disposed on opposing side the ground component 30. In alternative embodiments, the woven fabrics 10 may have a pile component disposed only along one side the woven terry fabric 10.

In accordance with various embodiments of the present disclosure, the ground component 30 includes sets of twisted yarns and sets of absorbent yarns. The twisted yarns may be twisted or plied continuous filament yarns or spun synthetic yarns. Each pile component 60,160 includes a plurality of piles 62,162 formed with absorbent pile yarns 64,164. The twisted yarns are adapted to transfer moisture from the absorbent pile yarns 64, 164 to the other absorbent yarns in the ground component 30 when the piles are exposed to moisture. The moisture transfer functionality between the ground component 30 and pile component 60,160 yields a woven fabric 10 with rapid drying characteristics. Furthermore, in certain embodiments, the twisted yarns can have twist configurations that result in improved cushioning, bulk, and durability.

Figure 4:
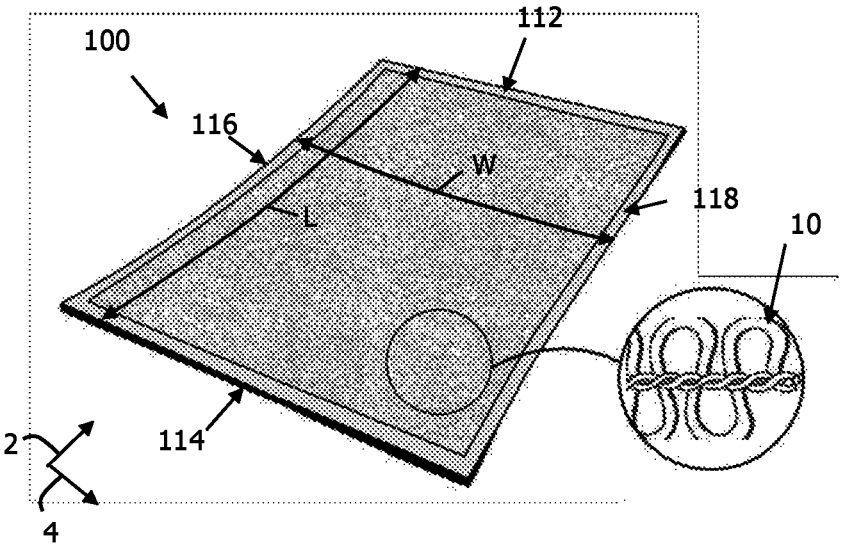
FIG. 4 is a schematic of an article in the form of a towel formed with the woven terry fabric shown in FIG. 1.

The woven terry fabric 10 may converted into a number of different articles. An "article" as used herein refers to product configurations that include, but are not limited to, towels, rugs, bath robes, and bedding items, such as sheeting, comforters, duvets, shams, pillow cases, and the like. The articles as described herein are suitable for home-uses (e.g. for products in bath or kitchen uses), commercial uses (e.g. towels designed for hotels, hospitality business, healthcare and restaurants), and/or industrial uses for cleaning or wiping of spills in industrial settings. An exemplary article in the form of a towel is illustrated in FIG. 4.

Continuing with FIGS. 1 and 2, the woven terry fabric 10 extends along a longitudinal direction 2 and includes opposed and selvedge edges 16 and 18 that are spaced apart with respect to each other along a lateral direction 4 that is perpendicular to the longitudinal direction 2. The longitudinal direction 2 can be referred to as the warp direction. The lateral direction 4 can be referred to as the weft direction. The woven terry fabric 10 includes a face 20 and a back 22 opposed to the face 20 along a vertical direction 6 that is perpendicular to the longitudinal direction 2 and lateral direction 4. The ground component 30 may include an upper side 32 and a lower side 34 spaced from the upper side 32 along the vertical direction 6. As illustrated, the first pile component 60 is disposed along the face 20 of the woven terry fabric 10 and the second pile component 160 is disposed along the back 22 of the woven terry fabric 10. The first pile component 60 projects away from the upper side 32 of the ground component 30 along the vertical direction 6 in a first direction 8*a*. The second pile component 160 projects from the lower side 34 along the vertical direction 6 in a second direction 8*b* that is opposite to the first direction 8*a*. Accordingly, the first pile component 60 can be referred to as an upper pile component and the second pile component 160 can be referred to as the lower pile component.

The mass distribution of the woven terry fabric 10 is selected to optimize moisture transfer and absorbency. For instance, the moisture transport yarns (e.g. warp yarns 40), may contribute to 10% to 30%, preferably between 15% to 20% of the weight of the woven terry fabric 10. The absorbent yarns in the ground, (e.g. the weft yarns 42) may comprise between 10% to 30% of the weight of the woven terry fabric 10. The pile components, such as absorbent pile yarns 64, 164 may comprise between about 50% to about 80%, preferably about 55% to about 70% by weight of the woven terry fabric 10. The ground component 30 and pile components 60, 160 will be described next.

The ground component 30 includes a plurality of ground warp yarns 40 and a plurality of weft yarns 42 woven together to define a woven structure. Exemplary woven structures for the ground component 30 include, but are not limited to, 1×1 plain weave, 2×1 rib weave, 2×2 rib weave, or 3×1 rib weave. The ground component may have range of warp end and pick densities as needed. In one example, the woven terry fabric can be formed to include between about 15 to about 50 ends/cm, preferably between about 20 and 30 ends/cm. The weft or pick density can range between about 10 picks/cm to about 30 picks/cm. Preferably, the weft density is between about 15 picks/cm to about 25 picks/cm. Other end densities and pick densities may be used and achieve the functions described herein.

Embodiments below will be described with reference to the warp yarns 40 configured with plied moisture transport filament yarns and the weft yarns 42 including absorbent yarns, as further detailed below. Furthermore, it is also contemplated that the warp yarns, the weft yarns, or both the warp and weft yarns may include any specific embodiment of the plied moisture transporting yarns as described below. In accordance with the embodiment illustrated in FIGS. 1 and 2, the warp yarns 40 includes plied moisture transporting yarns and the weft yarns 42 includes absorbent yarns. Moisture transport yarns as used herein are adapted to transfer moisture away from the plurality of absorbent pile yarns when the piles are exposed to moisture. The plied moisture transport yarns can be plied continuous filament yarns are plied synthetic spun yarns.

Turning to FIGS. 2 and 4, the warp yarn 40 may be plied continuous filament yarn 50 including at least two single end yarns. In accordance with the illustrated embodiment, the plied yarn 50 includes a first single end yarn 52 and a second single end yarn 54.

Each single end, continuous filament yarn 52, 54 may be formed from a number of different polymers, including polyethylene terephthalate (PET), polylactic acid (PLA), polypropylene (PP), polyamide 6 (PA6), or polyamide 6,6 (PA66), and conjugates or co-polymers of PET, PLA, PP, PA6, and PA66. The filaments may be homogeneous, bicomponent, or multicomponent filaments. The filaments may have non-circular or complex or cross-sectional shapes, such as multi-lobed, triangular, pie-shaped, etc. Furthermore, the continuous filament yarns may be dyed yarns. For example, each continuous filament yarn is a dope dyed, filament yarn. In another example, each continuous filament yarn is a packaged dyed yarn. In yet another example, each continuous filament yarn is dyed after fabric formation. In one example, the each continuous filament yarn can be a Drylon yarn. For instance, each continuous filament yarn can have a high bulk with larger diameters over an equivalent range of linear density.

Each continuous filament yarn 52, 54 comprise filaments with a range of linear densities. In one example, the continuous filaments are microfibers with a linear density less than about one (1) denier (sometimes referred to as 1 denier per filament (dpf). The term "microfiber" as used herein encompasses both continuous filaments or cut length staple fibers that have a denier less than about one (1). Accordingly, the plied continuous filament yarns or plied spun yarns (described below) may include microfibers. In addition, each continuous filament yarn may include fibers with a linear density greater than one (1) denier. In one example, the each continuous filament yarn may include filaments with a linear density up to about three (3) denier. The moisture transport yarns may include filaments that have a linear density greater than three (3) denier.

Continuing with FIGS. 2 and 4, the plied continuous filament yarn 50 has a structure that facilitates rapid drying characteristics and increased bulk and loft. As illustrated, the continuous filament plied yarn 50 has Z-twist imparted therein and the first single end yarn 52 and second single end yarn each has S-twist. Thus, the first and second single end yarns 52 and 54 each have a twist in one direction but the two yarns 52 and 54 are twisted together in an opposite direction to define the plied structure. Alternatively, the plied yarn 50 has S-twist and the first and second single end yarns 52 and 54 each have Z-twist.

Continuing with FIGS. 2 and 4, the first single end yarn 52 and the second single end yarn 54 may each have a twist level between about 200 turns per meter (tpm) to about 600 tpm. In one example, the twist level is between 300 tpm and 400 tpm. In one example, the twist level is about 350 tpm. In one example, the twist level is about 400 tpm. The two single end yarns 52 and 54 are then re-twisted in the opposite direction to form a 2-ply yarn, as discussed above and shown in FIG. 4. However, it should apparent that more than two single, end twisted yarns can be plied together to define the plied yarn 50. For example, the plied yarn 50 can be a 3 or 4 or more ply yarn. Further, the each component of plied yarn 50 can be a plied yarn structure. Furthermore, the plied yarn 50 may have a twist level between about 200 turns per meter (tpm) to about 600 tpm. In one example, the twist level of the plied yarn 50 is between 300 tpm and 400 tpm. In one example, the twist level of the plied yarn 50 is about 350 tpm. In one example, the twist level of the plied yarn 50 is about 400 tpm.

The linear density of the plied continuous filament yarn can vary according to the specific application and need. In accordance with the illustrated embodiment, the plied continuous filament yarns may have a linear density between about 100 denier to about 1000 denier. In one example, the plied continuous filament yarns have a linear density between about 100 denier to about 800 denier. In another example, the plied continuous filament yarns have a linear density between about 100 denier to about 700 denier. In another example, the plied continuous filament yarns have a linear density between about 100 denier to about 600 denier. In another example, plied continuous filament yarns have a linear density between about 150 denier to about 450 denier. Accordingly, in one example, a 2-ply continuous filament yarns have a denier of about 300 denier and each single end yarn 52 and 54 have a linear density of about 150 denier. In one example, a 2-ply continuous filament yarns have a denier of about 600 denier and each single end yarn 52 and 54 have a linear density of about 300 denier. Accordingly, while specific linear densities are not specifically described above, a person of skill in the art could appreciate that linear density of the single end yarn can be derived from the linear density of the plied yarn and the number of plies. However, each ply in the plied yarn could be different as needed. It should therefore be appreciated that the linear density of single end yarns and the plied yarn can vary as needed.

An alternative embodiment of the plied continuous filament yarn includes a plied yarn 50 formed of plies of spun synthetic yarns. Each spun synthetic yarn may be formed with fibers having a cut length, i.e., staple fibers. Suitable staple may be PET, PLA, PP, PA6, PA66 staple fibers, conjugates or co-polymers of PET, PLA, PP, PA6, and PA66 staple fibers. Staple fibers may be homogeneous, bi-component, or multicomponent fibers. Staple fibers may also include non-circular or complex or cross-sectional shapes, such as multi-lobed, triangular, pie-shaped, etc. Spun synthetic yarns can be any type of spun yarn structure. For example, the spun yarns can be ring spun yarns, open end yarns, or rotor spun yarns, or other spun yarn types. Furthermore, the spun synthetic yarns may be dyed yarns. For example, each spun synthetic yarn is a dope dyed spun yarn. In another example, each spun synthetic yarn is a packaged dyed yarn. In yet another example, each spun synthetic yarn is dyed after fabric formation.

The spun synthetic yarns are formed with fibers having a range of linear densities. In one example, the staple fibers are microfibers with a linear density less than about one (1) denier. In addition, each staple fiber may have a linear density greater than one (1) denier. In one example, the each staple fiber may include fibers with a linear density up to about three (3) denier or even greater than three (3) denier.

The plied synthetic yarns that are similar to the plied continuous filament yarn described above, in terms of twist structure and linear density. Accordingly, the plied spun synthetic yarns have at least two twisted single end spun yarns, such as a first single end yarn (similar to yarn 52) and a second single end yarn (similar to yarn 54). The plied spun synthetic yarn can have Z-twist imparted therein and the first single end spun yarn and second single end spun yarn each has S-twist. Alternatively, the plied spun yarn 50 has S-twist and the first and second single end, spun yarns each have Z-twist. During spun yarn formation or twisting, the singled yarns have a twist in a first direction. The singled end spun yarns are then re-twisted in the second, opposite, direction to form a 2-ply spun yarns. More than two single end spun yarns can be plied together to define plied spun yarn. For example, the spun plied yarn can be a 3 or 4 or more-ply yarn. Further, the each component of the spun plied yarn can be a plied yarn structure.

The linear density of the plied spun synthetic yarn can also vary according to the specific application and need. In accordance with the illustrated embodiment, the plied spun synthetic yarns may have a linear density between about 100 denier to about 1000 denier. In one example, the plied spun synthetic yarns have a linear density between about 100 denier to about 800 denier. In another example, the plied spun synthetic yarns have a linear density between about 100 denier to about 700 denier. In another example, the plied spun synthetic yarns have a linear density between about 100 denier to about 600 denier. In another example, plied spun synthetic yarns have a linear density between about 150 denier to about 450 denier. Accordingly, in one example, a 2-ply spun filament yarns have a denier of about 300 and each single end yarn 52 and 54 have a linear density of about 150 denier. In one example, a 2-ply spun filament yarns have a denier of about 600 and each single end yarn 52 and 54 have a linear density of about 300 denier. Accordingly, while specific linear densities are not specifically described above, a person of skill in the art could appreciate that linear density of the single end spun yarn can be derived from the linear density of the plied yarn and the number of plies. However, each ply in the plied spun synthetic yarn could be different as needed. It should therefore be appreciated that the linear density of single end spun yarns and the plied spun yarns can vary as needed.

The inventors have found that the use of plied yarns, whether continuous filament plied yarns or plied spun yarns, in the ground warp in combination with the process of twisting of at least two single end yarns 52 in a first twist direction and re-twisting or plying the single end yarns in opposite twist direction creates a plied yarn that, when woven into the woven terry fabric 10, results in improved cushioning, bounciness, and increased loft. The result is similar to the effect produced with high weight terry fabrics. Furthermore, use of plied yarns has been founds to be advantageous during weaving. For instance, plied yarns as described herein are subject to less end breaks and thus manufacturing efficiency is improved.

In an alternative embodiment, however, the warp yarns may include a single end, twisted continuous filament yarn as described above or a spun synthetic yarn as described above. Single end yarn configurations have similar liner densities to the plied yarns described above. Accordingly, the warp yarns 40 can be defined by a plied yarn 50 or by a single end yarn.

The weft yarns used in the ground component 30 will be described next. As discussed above, the weft yarns 42 of the ground component 30 can be absorbent yarns (or referred to herein as absorbent weft yarns 42). Absorbent yarns are natural fiber yarns, synthetic yarns, or natural and synthetic blended yarns with moisture absorbing properties. In one example, the absorbent weft yarns 42 are formed primarily from natural fibers. The natural fiber absorbent yarns may include primarily cotton fibers. Other natural fibers may include flax, bamboo, hemp, or other natural fibers. Synthetic yarns may include rayon fibers (e.g. Modal, Lyocell), microfiber staple fibers, or blends of PET and polyamide microfibers. Natural and synthetic blended yarns can include blends of cotton and PET staple fibers, cotton and PLA staple fibers, and cotton and PP staple fibers, blends of cotton and viscose rayon fibers. The present disclosure is not limited to cotton blends. Other natural and synthetic blends include cotton and staple fibers. Additional natural and synthetic blends include cotton and staple fibers with complex cross-sectional shapes. In another example, the natural and synthetic blended yarns can include cotton fibers in a core-spun construction with a synthetic filament comprising the core.

The absorbent weft yarns 42 can be any type of spun yarn structure. For example the absorbent weft yarns 42 can be ring spun yarns, open end yarns, or rotor spun yarns. In another embodiment, the absorbent weft yarns 42 can be Hygrocotton® brand yarns marketed by Welspun India Limited. Furthermore, yarns can be formed as disclosed in U.S. Pat. No. 8,833,075, entitled "Hygro Materials for Use in Making Yarns and Fabrics," (the 075 patent). The 075 patent is incorporated by reference into the present disclosure.

The absorbent weft yarns 42 have a count in a range between about 6 Ne to about 50 Ne. In one example, the absorbent weft yarns have a count of about 10 Ne. In another example, the ground warp yarns have a count of about 14 Ne. In another example, absorbent weft yarns have a count of about 24 Ne. In another example, absorbent weft yarns have a count of about 30 Ne. In another example, absorbent weft yarns have a count of about 36 Ne. In another example, absorbent weft yarns have a count of about 42 Ne. In another example, absorbent weft yarns have a count of about 50 Ne. In addition, absorbent weft yarns can be plied yarns. In one example, the absorbent weft yarn is 2-ply yarn. In another example, the absorbent weft yarn is a 3 or 4 or more-ply yarn.

The pile components 60, 160 will be described next. As discussed above, the woven terry fabric 10 includes a first pile component 60 and a second pile component 160 disposed opposite the first pile component 60 as shown in FIG. 2. Alternatively, the woven terry fabric 10 may include only single pile component 60. The first pile component 60 and the second pile component 160 each include a plurality of piles 62, 162 formed from absorbent pile yarns 64, 164. A "pile" as used herein is a pile loop or a cut pile. As illustrated, the woven terry fabric 10 includes pile loops. However, in addition or alternatively, the woven terry fabric 10 can include cut piles. The pile components generally contribute between 50% to about 80%, preferably between about 55% to 70% of the weight of the woven terry fabric 10.

The pile yarns 64, 164 are similar to the absorbent weft yarns 42 described above. For instance, the absorbent pile yarns 64, 164 include spun yarns formed from natural fibers, synthetic fibers with good moisture absorbency, natural and synthetic blended fibers. In one example, the absorbent pile yarns are formed primarily from natural fibers, such as cotton. Synthetic yarns may include rayon fibers (e.g. Modal, Lyocell), microfiber staple fibers, or blends of PET and polyamide microfibers. Blended absorbent pile yarns may include cotton and PET, etc. or cotton and viscose rayon. The absorbent pile yarns can be ring spun yarns, open end yarns, or rotor spun yarns, or the Hygrocotton® brand yarn.

The absorbent pile yarns have a count in a range between about 6 Ne to about 50 Ne. In one example, the absorbent pile yarns have a count of about 10 Ne. In another example, the absorbent pile yarns have a count of about 14 Ne. In another example, the absorbent pile yarns have a count of about 24 Ne. In another example, absorbent pile yarns have a count of about 36 Ne. In another example, absorbent pile yarns have a count of about 42 Ne. In another example, the absorbent pile yarns have a count of about 50 Ne. In addition, the absorbent pile yarns can be plied yarns. In one example, the absorbent pile yarns are a 2-ply yarns. In another example, the absorbent pile yarns are 3 or 4 or more-ply yarns.

In the embodiments provided herein, the absorbent pile yarns have a count that ranges from 6 Ne to 50 Ne with twist levels in the range from 1 to 24 turns per in (tpi). Woven terry fabrics 10 featuring higher yarn counts exhibit better absorbency. Lower tpi, such as between 1 tpi to about 24 tpi, results in higher void volume in the yarn and inter-fiber space is higher. The resulting yarn has an open structure that helps to achieve high surface area for absorption and wicking. This resulting bulk and rapid absorption in the piles helps transfer the moisture quickly to the ground component 30, where the moisture transporting yarns can be distribute the moisture quickly along the fabric to reduce drying times. It is believe that by distributing moisture over a greater surface area in a shorter time frame, the fabric drying rate increases.

Continuing with FIG. 4, a terry article 100 formed from the woven terry fabric 10 is illustrated. The terry article includes opposed ends 112 and 114 spaced apart along the longitudinal direction 2 and side edges 116 and 118 spaced apart along the lateral direction 4. The ends 112 and 114 and side edges 116 and 118 collectively define a perimeter, which in turn defines a size and shape of the terry article. The terry article 100 has a length L that extends from end 112 to end 114 along the longitudinal direction 2 and a width W that extends along the lateral direction 4. As illustrated, the length of the terry article 100 is greater than the width W so as to define shape of a bath towel or hand towel. The dimensions of the terry article 100 can be defined during manufacturing to any particular size.

Figure 5:
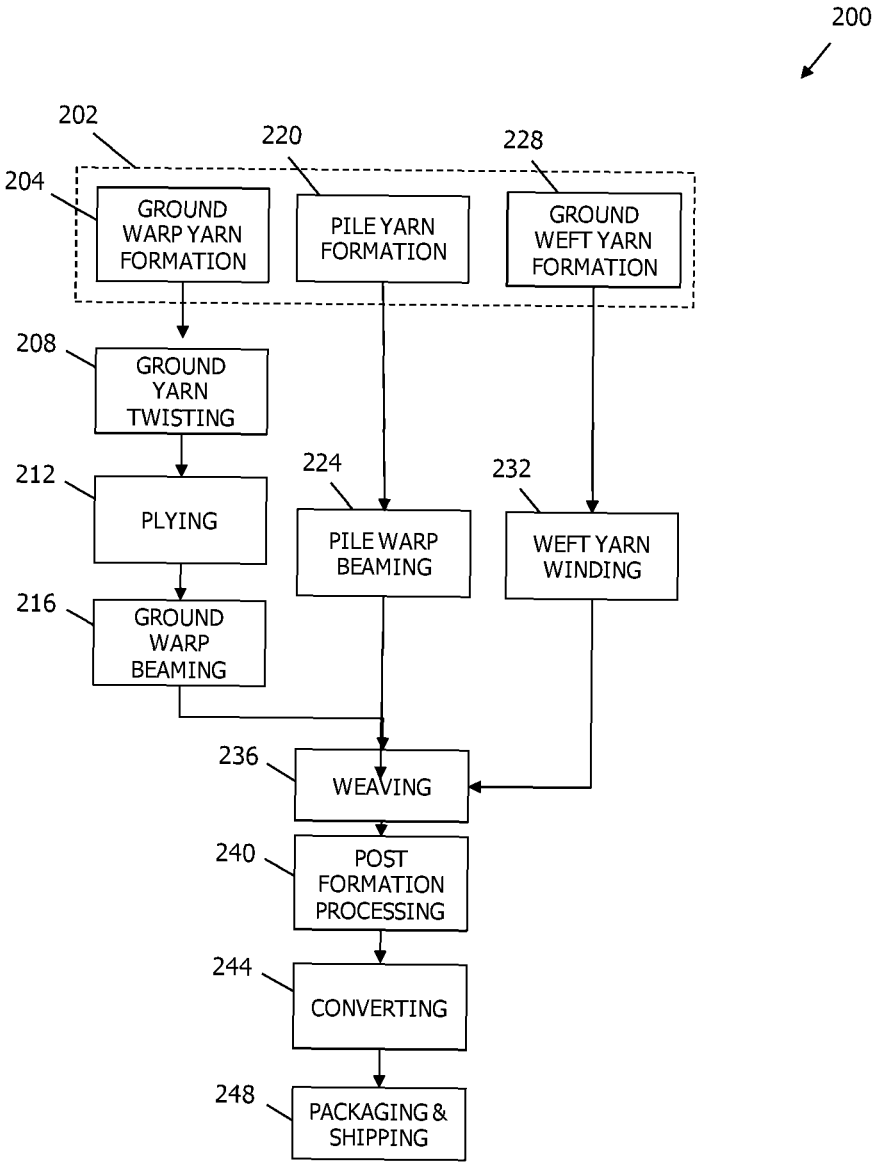
FIG. 5 is a flow diagram illustrating a process for manufacturing a terry fabric and related articles according to an embodiment of the present disclosure.

A process 200 for making a terry article according to an embodiment of the disclosure is illustrated in FIG. 5. The process 200 includes a yarn formation 202, which includes steps for: a) ground warp yarn formation, b) ground weft yarn formation, c) the pile yarn formation. In embodiments where the woven terry fabric 10 includes an upper pile component 60 and a lower pile component 160, yarn formation 202 includes forming additional pile yarns 164 for the lower pile component 160. Exemplary yarn formation phases will be described next.

The yarn formation including a ground warp yarn formation step 204. In accordance with the illustrated embodiment, the ground warp yarns may plied continuous filament yarns. The plied continuous filament yarns are initially formed via melt spinning and are adapted to transport moisture. In melt spinning, polymer resins (such as PET, PLA, PP, etc.) are melted and extruded through orifices at temperatures that approach the polymer melting temperature (Tm) to form filaments with low denier per filament (dpf). From the orifices, the extruded filaments are quenched, and slightly tensioned by passing over one or more godets before being wound onto a desired yarn packages for subsequent processing. Melt spinning may result in oriented or partially oriented yarns. Additional bulking or texturizing steps may be included to increase the bulk. For example, such as in the manufacture of Drylon yarns. Continuous filament formation steps result in continuous filament yarns with the desired linear density as described above. Additional processes may be needed if moisture transport yarns are using bicomponent technology.

In an alternative embodiment, as described above, plied yarns are formed with spun synthetic yarns formed using staple yarn spinning systems. Such yarn spinning systems may include bale opening, carding, optionally combing, drafting, roving, and yarn spinning (yarn spinning processes are not illustrated as it is known in the art.) to the desired count and twist level. After yarn spinning, the spun synthetic yarns are wound into the desired yarn packages for ground beaming spun synthetic yarn can be formed using open end spinning systems or rotor spun spinning systems. In accordance with the alternative embodiment, the spun synthetic yarns may be plied before proceeding to warp beaming step 216.

After ground yarn formation 204, the continuous filament yarns are subjected to a twisting operation 208 were a desired level of twist is imparted into the continuous filament structure. The twisting operation 208 imparts twist into each filament yarn end to yield the twisted single end yarns (FIG. 4).

After twisting 208, a plying operation twists first and second single end yarns 52 and 54 into a plied yarn 50. The plied yarn 50 has Z-twist and each twisted single end yarn 52 and 54 has S-twist. Alternatively, the plied yarn 50 has S-twist and each twisted single end yarn 52 and 54 has Z-twist. After the plying step 212, the plied yarns 50 are beamed in a warp beaming step 216 further described below. Alternatively, the twisted single end yarns 52, 54 can proceed directly to warp beaming step 216.

Pile yarn formation 220 can include various staple yarn spinning systems as described above. After yarn spinning, the absorbent pile yarns are wound into the desired yarn packages for pile beaming step 224. In one example, ring spinning is the preferred spinning system. However, the pile warp yarns can be formed using open end spinning systems or rotor spun spinning systems. Furthermore, the spinning systems may include methods to form the Hygrocotton®, as disclosed in the 075 patent. The 075 patent is incorporated by reference into present disclosure. In some cases, the pile yarns can be twisted structures that are plied into 2-ply, 3-ply, 4-ply, or multi-ply configurations in a plying step that is similar to the plying step 212 used for the ground warp yarns. In embodiments that include an upper pile component 60 and a lower pile component 160, the pile formation step 220 includes forming lower pile yarns 64 and upper pile yarns 164.

Ground weft yarn formation 228 involves similar fiber types and the same or similar yarn spinning systems that are used to form the absorbent pile yarns. After weft yarn formation 228, the absorbent weft yarns are wound onto desired packages in winding step 232. The wound packages are then staged for weft insertion during fabric formation step 236 discussed below. As needed, the absorbent weft yarns may be plied in 2-ply, 3 ply, 4-ply, multi-ply configurations in a plying step similar to the plying step 212 used for the ground warp yarns.

Following the yarn formation 202, the ground warp yarns and absorbent pile yarns proceed to ground and pile beaming steps 216 and 224, respectively. The ground warp beaming step 216 include arranging the ground yarns in a parallel form onto a ground warp beam. The warp beaming step 216 may include a sizing step where a typical sizing agent is applied to each ground warp yarn to aid in fabric formation. The ground warp beaming step 216 results in a warp beam of ground warp yarns prepared for weaving. The pile warp beaming step 224 is similar to the ground warp beaming and includes—warping and sizing. The pile warp beaming step 224 results in at least one pile warp beam. In embodiments that include upper and lower pile components 60 and 160, the pile beaming step 224 includes preparing two separate pile warp beams: one upper pile warp beam and lower pile warp beam. The ground and pile warp beams are positioned on respective mounting arms or mounting brackets proximate the weaving loom (not shown).

Continuing with FIG. 5, following the ground warp and pile warp beaming steps, a weaving step 236 forms the woven terry fabric 10. In the weaving step 236, the ground component 30 and the pile component on one side (or both sides) of the ground component 30 are woven together using a weaving loom designed for terry weaving. More specifically, in the weaving step 236, each ground warp moisture transport yarn and absorbent pile yarn from the respective warp beams are drawn-in (not shown) through various components of a weaving loom, such as drop wires, heddle eyes attached to a respective harness, reed and reed dents, in a designated order as is known in the art.

After drawing-in is complete, the weaving step 236 proceeds through two phases: a ground component formation phase and a pile component formation phase. Both phases include a shedding motion to facilitate interweaving the weft yarns with the ground warp yarns and pile warp yarns to create the desired woven terry fabric construction. A reed motion and warp take-off system is utilized to form the piles during the pile component phase and such a mechanism using a terry weaving loom is well known and will not be repeated here.

During the ground component phase of the weaving step 236, the absorbent weft yarns are interwoven with the ground warp moisture transport yarns 40 to define the ground component 30 or ground fabric. Exemplary ground fabric woven constructions include: a 1×1 plain weave, 2×1 rib weave, 2×2 rib weave, or 3×1 rib weave. Other woven constructions in the ground fabric are possible as well. The ground component formation phase can utilize different weft insertion techniques, including air-jet, rapier, or projectile type weft (fill) insertion techniques.

The pile component phase of the weaving step 236 includes interweaving the first set of absorbent pile yarns 64 (via the first warp) with the ground warp yarns 40 and weft yarns 42 to create a piles 62 that extend away from the ground component 30 along a vertical direction 6 (FIG. 2). In addition, the weaving step may include weaving the second set of absorbent pile yarns 164 with the ground warp moisture transport yarns 40 and absorbent weft yarns 42 to form the second set of piles 162. If plied yarns are used to create the piles, the piles will have a spiral shape. Otherwise, the piles have what is referred to as an upright shape.

The weaving step 236 can form woven terry fabrics having any number of different fabric constructions. In one example, the woven terry fabric is formed to result in a 3-pick up to 7-pick (or more) terry weave pattern. In one example, the woven terry fabric can be formed to include between about 15 to about 50 ends/cm, preferably between about 20 and 30 ends/cm. The weft or pick density can range between about 10 picks/cm to about 30 picks/cm. Preferably, the weft density is between about 15 picks/cm to about 25 picks/cm.

Following weaving step 236, the woven terry fabric is subjected to a post-formation processing step 240. The post-formation processing includes desizing, bleaching step (for cotton containing fabrics), dyeing and finishing. The desizing bleaching phases are according to known techniques. The dyeing phase imparts color into the woven terry fabric 10. For instance, the dying phase may include applying reactive dyes to natural fiber yarns, and cotton yarns in particular. For instance, in one example the moisture transport yarns 40 are doped dyed, continuous filament yarns. Thus, the dyeing face may include dyeing only the natural fiber component. However, it certain embodiments where dope-dyed or yarn dyed yarns are not used, disperse dyes may be used for PET yarns. During dyeing, either batch (e.g. vat dying), semi-continuous, or continuous dyeing systems can be used to dyes the woven terry fabric 10. Other dyes can be used depending on the particular fiber blend. The dyeing phase may include steaming to set the dyes. The finishing phase applies one or functional agents are added to the woven terry fabric 10 to improve or augment performance characteristics. The woven terry fabric 10 is again steam-dried and fluffed in a drying phase. In converting step 244, the dyed woven terry fabric 10 is cut, sewn or otherwise assembled into a terry article. In step 248, the terry articles are packaged and shipped.

Furthermore, the foregoing description of the specific embodiments are such, that, one of skill in art can readily modify or adapt for various applications such specific embodiments without departing from the generic concept, and, therefore, such adaptations and modifications should and are intended to be within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

What is claimed is:

1. A terry fabric, comprising:

a ground component comprising:

a plurality of warp yarns composed of one of a plied synthetic yarn and an absorbent yarn; and a plurality of weft yarns composed of one of a plied synthetic yarn and an absorbent yarn and the plurality of weft yarns are interwoven with the plurality of warp yarns such that the plurality of warp yarns and the plurality of weft yarns are both not absorbent yarns, wherein the plied synthetic yarn includes at least two single end yarns, and each of the at least two single end yarns are either a) continuous filament yarns or b) spun synthetic yarns;

a pile component that projects from the ground component in a direction away from the ground component, the pile component including a plurality of piles that include absorbent pile yarns interwoven with the plurality warp yarns and the plurality of weft yarns wherein the plied synthetic yarns are adapted to transfer moisture away from the plurality of absorbent pile yarns to the other yarns when the piles are exposed to moisture, such that terry fabric has rapid drying characteristics.

2. The terry fabric of claim 1, wherein the plied synthetic yarns has one of a Z-twist or an S-twist, and each twisted single end yarn has the other of the Z-twist or the S-twist.

3. The terry fabric of claim 1, wherein the plied synthetic yarn includes one of: two twisted single end yarns; three twisted single end yarns; or four twisted single end yarns.

4. The terry fabric of claim 1, wherein the plurality of absorbent pile yarns include natural fibers.

5. The terry fabric of claim 1 wherein the plurality of absorbent pile yarns include a blend of natural and synthetic fibers.

6. The terry fabric of claim 4, wherein the natural fibers are cotton fibers.

7. The terry fabric of claim 1, wherein the plied synthetic filament yarns, the absorbent weft yarns, and the absorbent pile yarns are woven together into a three-pick terry weave up to a seven-pick terry weave.

8. The terry fabric of claim 1, wherein the plurality of warp yarns include the plied synthetic yarns and the plurality of weft yarns include the absorbent yarns.

9. The terry fabric of claim 1 wherein the plurality of weft yarns include the plied-synthetic yarns and the plurality of warp yarns include the absorbent yarns.

10. The terry fabric of claim 1, wherein the plurality of warp yarns include the plied synthetic yarns and the plurality of weft yarns include the plied-synthetic yarns.

11. The terry fabric of claim 1, wherein the absorbent yarns in the ground component include natural fibers.

12. The terry fabric of claim 1, wherein the absorbent yarns in the ground component include a blend of natural and synthetic fibers.

13. The terry fabric of claim 12, wherein the natural fibers are cotton fibers.

14. The terry fabric of claim 12, wherein the absorbent yarns are single end yarns or plied yarns.

15. A terry fabric, comprising:

a ground component comprising:

a plurality of warp yarns and a plurality of weft yarns interwoven with the plurality of warp yarns, at least one of the plurality of warp yarns and the plurality of weft yarns include a) twisted synthetic yarns and b) absorbent yarns; and a pile component that projects from the ground component in a direction away from the ground component, the pile component including a plurality of piles that include absorbent pile yarns interwoven with the plurality warp yarns and the plurality of weft yarns, and the absorbent pile yarns are hygro yarns having an open core, wherein the twisted synthetic yarns are adapted to transfer moisture away from the plurality of absorbent pile yarns to the other yarns when the piles are exposed to moisture, such that terry fabric has rapid drying characteristics.

16. A method of making a terry article, the method comprising:

forming plied synthetic yarns that includes at least two single end yarns, wherein each of the at least two single end yarns are either a) continuous filament yarns or b) spun synthetic yarns;

weaving on a loom a ground component and a plurality of piles, such that the ground includes a plurality of warp yarns with a plurality of weft yarns, and the plurality of piles are formed from absorbent pile yarns, wherein at least one of the plurality of warp yarns and the plurality of weft yarns include single end yarns and the other of the warp yarns and weft yarns include the plied synthetic yarns; and converting the terry fabric into a terry article.

17. The method of claim 16, further comprising the steps of:

twisting single end yarns into twisted single end yarns; and twisting at least two of the twisted single end yarns into the plied yarn.

18. The method of claim 17, wherein the step of twisting the single end yarn includes twisting the single end yarns in a first twist direction to define a z-twist or an s-twist, and the step of twisting the at least two twisted yarns includes twisting the at least two twisted yarns in a second twist direction that is opposite the first twist direction to define the other of the z-twist or the s-twist.

19. The method of claim 16, wherein the plied synthetic yarns are plied continuous filament yarns.

20. The method of claim 16, wherein the plied yarns are plied synthetic spun yarns.

21. The terry fabric of claim 1, wherein the plurality of absorbent pile yarns include a blend of natural and synthetic fibers.

22. The terry fabric of claim 5, wherein the natural fibers are cotton fibers.

23. The terry fabric of claim 11, wherein the natural fibers are cotton fibers.

24. The terry fabric of claim 11, wherein the absorbent yarns are single end yarns or plied yarns.

25. The terry fabric of claim 1, wherein the absorbent pile yarns comprise between about 50% to about 80% by weight of the terry fabric.

26. The terry fabric of claim 25, wherein the absorbent yarns in the ground comprise between about 10% to about 30% by weight of the terry fabric.

27. The terry fabric of claim 25, wherein the at least two single end yarns are twisted together to have a twist level between about 200 to about 600 turns per meter.

28. The terry fabric of claim 27, wherein each single end yarn has a twist level between 200 to about 600 turns per meter.

29. The terry fabric of claim 25, wherein the absorbent pile yarns have a count between 6 Ne and 50 Ne and a twist level between 1 and 24 turns per inch.

30. The terry fabric of claim 1, wherein the absorbent pile yarns are hygro yarns having an open core.

31. The terry fabric of claim 15, wherein the absorbent pile yarns comprise between about 50% to about 80% by weight of the terry fabric.

32. The terry fabric of claim 31, wherein the absorbent yarns in the ground comprise between about 10% to about 30% by weight of the terry fabric.

33. The terry fabric of claim 15, wherein the plied synthetic yarns include at least two single end yarns, and each of the at least two single end yarns are either a) continuous filament yarns or b) spun synthetic yarns.

34. The terry fabric of claim 32, wherein the at least two single end yarns are twisted together to have a twist level between about 200 to about 600 turns per meter.

35. The terry fabric of claim 34, wherein each single end yarn has a twist level between 200 to about 600 turns per meter.

36. The terry fabric of claim 15, wherein the absorbent pile yarns are cotton yarns or cotton blended yarns.

37. The method of claim 16, further comprising forming absorbent pile yarns to have a hygro yarn structure with an open core.

38. The method of claim 17, where the twisting step creates soft, bulkt, and lofty plied yarns.

* * * * *